US010183326B2

(12) United States Patent
Yamamoto et al.

(10) Patent No.: US 10,183,326 B2
(45) **Date of Patent: *Jan. 22, 2019**

(54) SLAB CONTINUOUS CASTING APPARATUS

(71) Applicant: SHINAGAWA REFRACTORIES CO., LTD., Tokyo (JP)

(72) Inventors: Kenji Yamamoto, Tokyo (JP); Yoshifumi Shigeta, Tokyo (JP); Mototsugu Osada, Tokyo (JP); Atsushi Takata, Tokyo (JP)

(73) Assignee: SHINAGAWA REFRACTORIES CO., LTD., Tokyo (JP)

( * ) Notice: Subject to any disclaimer, the term of this patent is extended or adjusted under 35 U.S.C. 154(b) by 55 days.

This patent is subject to a terminal disclaimer.

(21) Appl. No.: 15/542,710

(22) PCT Filed: Oct. 13, 2015

(86) PCT No.: PCT/JP2015/078904

§ 371 (c)(1),
(2) Date: Jul. 11, 2017

(87) PCT Pub. No.: WO2016/113965

PCT Pub. Date: Jul. 21, 2016

(65) Prior Publication Data

US 2017/0368597 A1 Dec. 28, 2017

(30) Foreign Application Priority Data

Jan. 16, 2015 (JP) ..... 2015-006467

(51) Int. Cl.
*B22D 11/103* (2006.01)
*B22D 41/56* (2006.01)
(Continued)

(52) U.S. Cl.
CPC ..... *B22D 11/103* (2013.01); *B22D 11/10* (2013.01); *B22D 11/141* (2013.01); *B22D 11/18* (2013.01);
(Continued)

(58) Field of Classification Search
CPC ..... B22D 11/10; B22D 11/103; B22D 11/141; B22D 11/18; B22D 41/50; B22D 41/507; B22D 41/56
See application file for complete search history.

(56) References Cited

U.S. PATENT DOCUMENTS 4,998,650 A * 3/1991 Yamazaki ..... B22D 41/26 222/591
7,108,046 B2 * 9/2006 Kawano ..... B22D 41/50 164/437
(Continued)

FOREIGN PATENT DOCUMENTS

JP 50-103427 8/1975
JP 58-77754 5/1983
(Continued)

OTHER PUBLICATIONS

International Search Report dated Jan. 12, 2016 in International (PCT) Application No. PCT/JP2015/078904.

*Primary Examiner* — Kevin E Yoon
(74) *Attorney, Agent, or Firm* — Wenderoth, Lind & Ponack, L.L.P.

(57) ABSTRACT

A slab continuous casting apparatus according to this invention is configured to supply molten metal from a tundish to a slab water-cooled mold through at least an upper nozzle, a stopper, and an immersion nozzle and solidify the molten metal, and is provided with an immersion nozzle quick replacement mechanism. The slab continuous casting apparatus includes a discharge direction change mechanism that is provided between the stopper and the immersion nozzle and is capable of freely changing a discharge angle of the molten metal in a horizontal cross-section during casting.

6 Claims, 9 Drawing Sheets

(51) Int. Cl.

| | |
|---|---|
| ***B22D 11/10*** | (2006.01) |
| ***B22D 11/18*** | (2006.01) |
| ***B22D 41/50*** | (2006.01) |
| ***B22D 11/14*** | (2006.01) |

(52) U.S. Cl.
CPC ..... *B22D 41/50* (2013.01); *B22D 41/507* (2013.01); *B22D 41/56* (2013.01)

(56) References Cited

U.S. PATENT DOCUMENTS

| | | | | |
|---|---|---|---|---|
| 8,708,204 | B2 * | 4/2014 | Nystrom ..... | B22D 41/20 222/602 |
| 10,029,303 | B2 * | 7/2018 | Yamamoto ..... | B22D 41/56 |
| 2012/0175542 | A1 * | 7/2012 | Yamamoto ..... | B22D 41/34 251/318 |

FOREIGN PATENT DOCUMENTS

| | | |
|---|---|---|
| JP | 62-259646 | 11/1987 |
| JP | 62-270260 | 11/1987 |
| JP | 62-270261 | 11/1987 |
| JP | 63-203259 | 8/1988 |
| JP | 1-72942 | 5/1989 |
| JP | 2000-263199 | 9/2000 |
| WO | 2015/136736 | 9/2015 |

* cited by examiner

SLAB CONTINUOUS CASTING APPARATUS

TECHNICAL FIELD

This invention relates to a slab continuous casting apparatus, and more particularly, to a novel improvement for freely changing a discharge angle of molten metal during casting to swirl and agitate molten metal in a slab mold.

BACKGROUND ART

In recent years, it is a common practice for the mass production of ingots (also called "slabs") of steel, various kinds of alloys or the like to use a so-called "continuous casting method", which involves continuously pouring an alloy or the like in a molten state into a water-cooled mold and gradually drawing a solidified ingot from the mold.

The practical use of continuous casting was originated by continuous casters for billets and blooms, and subsequently, continuous casting of slabs having a large cross-sectional area has become widespread due to the strong demand for energy saving and improvement in productivity.

In order to obtain a high-quality ingot with less nonmetallic inclusions and less component segregation by continuous casting, it is important to appropriately agitate molten metal in the course of solidification. Agitation of molten metal in a slab having a large cross-sectional area and having a large aspect ratio of its cross-sectional shape (for example, the ratio of the length of a long side wall to the length of a short side wall is 5 or more) is liable to cause center segregation and center section cracks and deteriorate processability unlike a slab having a small cross-sectional area and having a substantially square cross-sectional shape, such as blooms and billets, and hence it is required to appropriately agitate the molten metal.

Known examples of technologies of molten metal agitation in continuous casting that deal with the requirement include a method in which an electromagnetic agitation device is provided in the vicinity of a cooled mold or on the back surface of the cooled mold, and molten metal is agitated by using electromagnetic force. The electromagnetic agitation device is, however, extremely expensive, and alternative inexpensive devices for agitating molten metal in a cooled mold have been sought after.

As solutions using inexpensive devices, the methods as disclosed in PTL 1 to 6 have been proposed for blooms and billets of which cross-sectional shapes are substantially square.

PTL 1 proposes a method in which molten metal is discharged from four discharge holes provided rotationally symmetrically at a lower part of an immersion nozzle to a square mold surface in an oblique direction, preferably at an angle of (45±10)°, thereby generating a horizontal swirling flow in molten metal in a mold. This method improved quality of slabs such as blooms and billets, but the degree of its effect was not always considered sufficient. PTL 2 adds improvements to PTL 1 to propose a method in which molten metal is discharged from four discharge holes in discharge directions inclined at a given angle with respect to respective mold surfaces of a square mold rather than being rotationally symmetric, that is, in discharge directions inclined at about ½ of an angle formed by the normal to each side from the center of an immersion nozzle and a diagonal of the square with respect to the normal, thereby causing a horizontal swirling flow in molten metal in the mold and agitating the molten metal in the mold, and PTL 2 indicates that the quality of slabs is improved. These methods, which assume molds for blooms and billets, achieve certain results by supplying molten metal to both of the long sides and the short sides, but in the case of slabs, the methods have a problem in that it is difficult to supply molten metal to end surfaces of the long sides and sufficient agitation effect of molten metal cannot be obtained.

PTL 3 to 6 propose methods in which an immersion nozzle is rotatable such that molten steel is poured into a mold while being swirled, thereby agitating the molten steel in the mold.

PTL 3 proposes a method involving rotatably supporting an immersion nozzle through bearings, providing a clearance between a lower end of a tundish nozzle and an upper end portion of the immersion nozzle, introducing inactive gas to prevent oxygen in the atmosphere from being taken into molten steel through the clearance, and continuously rotating the immersion nozzle at a predetermined number of revolutions by a drive device provided outside. PTL 3 indicates that a horizontal swirling flow is thus generated to agitate molten steel in a mold, and the quality of slabs is improved.

PTL 4 and PTL 5 relate to improvements of PTL 3. PTL 4 proposes a method in which the same mechanism of holding and rotating the immersion nozzle as in PTL 3 is used, but instead of the drive device, reaction of molten steel discharged from discharge holes of the immersion nozzle that are inclined at an angle in a circumferential direction from the center axis with respect to a radial direction is used to continuously rotate the nozzle. PTL 4 indicates that the method of agitating molten steel by rotating the immersion nozzle at the number of revolutions corresponding to the flow rate of the molten steel enables a horizontal swirling flow to be generated to agitate molten steel in a mold, and the quality of slabs is improved. PTL 5 proposes a method involving providing an immersion nozzle with discharge holes at height positions different between right and left discharge holes such that molten steel is poured into a mold from different heights, rotatably supporting the immersion nozzle, and continuously rotating the immersion nozzle at a predetermined number of revolutions by a drive device, thereby efficiently agitating the molten steel. PTL 5 indicates that a swirling flow is generated in the horizontal direction and in the vertical direction to agitate the molten steel in the mold, and the quality of slabs is improved.

In these cases, there is a problem in that when molten steel flows from a tundish nozzle to an immersion nozzle, the pressure in a clearance between the tundish nozzle and the immersion nozzle is decreased in accordance with Bernoulli's law, and a large amount of inactive gas is blown into the molten steel through the clearance, with the result that a large amount of air bubbles is taken in a slab. These methods have achieved effects in terms of molten steel agitation, but when applied to slabs, the methods still have a problem in that it is difficult to supply molten steel to end surfaces of the long sides and sufficient agitation effect of molten metal cannot be obtained.

PTL 6 proposes a twin-roll continuous casting machine configured such that a flange is provided at a lower part of a nozzle extended portion and is brought into slide contact with a flange provided at an upper part of an immersion nozzle, the flanges are pushed against each other by springs or the like, and a drive device is provided to continuously rotate the immersion nozzle at a predetermined number of revolutions. PTL 6 indicates that hot molten steel from a tundish is thus ejected uniformly to the inside of a mold such that molten steel temperatures in the mold are made uniform to prevent the generation of wall shells, and the quality of slabs is improved. If this method is directly applied to an iron-making slab continuous casting machine, however, wear of the above-mentioned slide contact portion becomes a problem. The use of a solid lubricant to achieve lubricity is conceivable, but it is not always effective.

Further, if the methods as disclosed in PTL 3 to 6 in which the discharge directions are continuously rotated to provide a swirling flow to molten steel in a mold are applied to a slab continuous casting machine, there is a problem in that it is difficult to supply molten steel to both o the long sides and the short sides, in particular, difficult to supply molten steel to end surfaces of the long sides, and sufficient agitation effect of molten steel cannot be obtained.

As a solution, PTL 7 proposes a method in which, in a slab continuous casting machine, a two-hole immersion nozzle is mounted and installed such that discharge directions of molten steel fall within the range between the normal from the center axis of the immersion nozzle to the short side of a mold and a diagonal of the mold, thereby supplying molten steel to end surfaces of the long sides while concentrating the molten steel, and smoothly agitating the molten steel. PTL 7 indicates that a molten steel continuous casting method capable of eliminating excessive supply of discharge flows contacting with long-side wall surfaces to prevent breakouts and manufacturing high-quality ingots is provided to further improve the quality of slabs.

In continuous casting, a method of continuing continuous casting by replacing with a ladle filled with new molten steel while using molten steel stored in a tundish as a buffer is referred to as continuous-continuous casting (meaning that continuous casting is continued), and the number of ladles used for continuous-continuous casting is referred to as continuous-continuous number. It is preferred to increase the continuous-continuous number in terms of energy and economics. However, the immersion nozzle in continuous casting is always immersed in molten metal. Oxide slag called "mold powder" is formed in a water-cooled mold for continuous casting in order to achieve lubricity between solidified shell of steel and the water-cooled mold. There is a problem in that a part of the immersion nozzle in contact with the oxide slag causes much erosion and the continuous-continuous number cannot be increased. This problem is solved by appropriately replacing with anew immersion nozzle during continuous-continuous casting. The replacement of immersion nozzles during continuous-continuous casting is called "immersion nozzle quick replacement", and, for example, an immersion nozzle quick replacement mechanism as disclosed in PTL 8 has been introduced.

Also in continuous casting having such an immersion nozzle quick replacement mechanism, it is required to appropriately agitate molten metal.

CITATION LIST

Patent Literature

[PTL 1] Japanese Patent Application Publication No. S58-77754

[PTL 2] Japanese Examined Patent Publication No. H1-30583

[PTL 3] Japanese Patent Application Publication No. S62-259646

[PTL 4] Japanese Patent Application Publication No. S62-270260

[PTL 5] Japanese Patent Application Publication No. S62-270261

[PTL 6] Japanese Utility Model Application Publication No. H1-72942

[PTL 7] Japanese Patent Application Publication No. 2000-263199

[PTL 8] Japanese Patent No. 4669888

SUMMARY OF INVENTION

Technical Problem

The conventional slab continuous casting apparatuses, which are configured as described above, have the following problems.

Specifically, the slab continuous casting apparatus in PTL 7, which has been proposed to overcome the problem of the slab continuous casting apparatuses in PTL 1 to 6, still has the following problems.

Specifically, inclusions often deposit in the vicinity of discharge holes in an immersion nozzle during pouring, and the deposition position is not always symmetric with the discharge direction. If the deposition position is not symmetric with the discharge direction, there is a problem in that the direction of a discharge flow often changes during pouring from its initial direction at the time when the immersion nozzle is mounted, and hence a sufficient swirling flow cannot be obtained in the middle of pouring. In recent years, the lifetime of immersion nozzles and other components has been increased such that the service life of immersion nozzles and other components is long enough for casting with a plurality of ladles, thus enabling slabs of different kinds of steel and slabs having different widths of water-cooled molds to be continuously cast. Accordingly, a method of continuous casting involving changing the width or thickness of a mold during casting is often employed, but the method in PTL 7 has a problem in that an optimum angle for obtaining a swirling flow of molten metal cannot be set when the width or the thickness is changed.

The method of mounting the immersion nozzle at a given angle as described above has a problem in that even when a sufficient swirling flow is obtained at an initial stage, sufficient agitation effect of molten metal cannot always be obtained in the middle.

This invention has been made in order to solve the problems described above, and in particular, it is an object of this invention to provide a slab continuous casting apparatus configured to freely change a discharge angle of molten metal during casting so as to stably swirl and agitate molten metal in a slab mold.

Solution to Problem

A slab continuous casting apparatus according to this invention is configured to supply molten metal 3 from a tundish 1 to a slab water-cooled mold 2 through at least an upper nozzle 4, a stopper 5, and an immersion nozzle 10, and is provided with an immersion nozzle quick replacement mechanism 20, the slab continuous casting apparatus including a discharge direction change mechanism 30 that is provided between the stopper 5 and the immersion nozzle 10 and is capable of freely changing a discharge angle of the molten metal 3 in a horizontal cross-section during casting.

The discharge direction change mechanism 30 includes: a sliding surface 40 provided on at least a top surface 10*a* of the immersion nozzle 10; an immersion nozzle quick replacement mechanism 20; and a drive mechanism 70 for changing a discharge direction of the molten metal 3 discharged from the immersion nozzle 10.

The immersion nozzle quick replacement mechanism 20 includes: a base 21; a clamper 23 supported through a clamper pin 62 provided on the base 21; and a spring 22 provided on the base 21 and used for biasing the clamper 23 upward. The clamper 23 and the spring 22 are a pair of mechanisms provided to be opposed to each other at 180 degrees. The clamper 23 is configured to support a flange bottom surface 25*a* of the immersion nozzle 10 inserted along a guide rail 26, and by being biased upward by the spring 22, hold the immersion nozzle 10 and push the immersion nozzle 10 upward.

The drive mechanism 70 for changing a discharge direction of a discharge port 10*b* in the immersion nozzle 10 includes: a drive device 71 that applies a force for changing the direction; and a transmission unit 90 that transmits the force from the drive device 71 to the immersion nozzle quick replacement mechanism 20, and the drive device 71 is operated such that the immersion nozzle 10 together with the immersion nozzle quick replacement mechanism 20 holding the immersion nozzle 10 is horizontally swirled around a center axis of the immersion nozzle 10.

The top surface 10*a* of the immersion nozzle 10 is in slide contact with a bottom surface 9*a* of a lower nozzle 9 located below the stopper 5, or in slide contact with a bottom surface of the upper nozzle 4 paired with the stopper 5.

Advantageous Effects of Invention

The slab continuous casting apparatus according to this invention is configured as described above, and can thus obtain the following effects.

Specifically, a slab continuous casting apparatus configured to supply molten metal from a tundish 1 to a slab water-cooled mold 2 through at least an upper nozzle 4, a stopper 5, and an immersion nozzle 10, and provided with an immersion nozzle quick replacement mechanism includes a discharge direction change mechanism 30 that is provided between the stopper 5 and the immersion nozzle 10 and is capable of freely changing a discharge angle of the molten metal 3 in a horizontal cross-section during casting. Consequently, a discharge flow 3*a* from the immersion nozzle 10 can be freely oriented in a particular direction during casting to provide a swirling flow to molten metal, and even when the discharge angle has changed due to deposition of inclusions in a discharge hole or when the thickness or width of the mold is changed, an appropriate discharge angle can be set.

The discharge direction change mechanism 30 includes: the sliding surface 40 provided on at least the top surface 10*a* of the immersion nozzle 10; the immersion nozzle quick replacement mechanism 20; and the drive mechanism. 70 for changing the discharge direction of the molten metal 3 discharged from the immersion nozzle 10. Consequently, the immersion nozzle can be easily rotated.

The immersion nozzle quick replacement mechanism 20 includes: the base 21; the clamper 23 supported through the clamper pin 62 provided on the base 21; and the spring 22 provided on the base 21 and used for biasing the clamper 23 upward. The clamper 23 and the spring 22 are a pair of mechanisms provided to be opposed to each other at 180 degrees. The clamper 23 is configured to support the flange bottom surface 25*a* of the immersion nozzle 10 inserted along the guide rail 26, and by being biased upward by the spring 22, hold the immersion nozzle 10 and push the immersion nozzle 10 upward.

The drive mechanism 70 for changing the discharge direction, which is configured to change a discharge direction of a discharge port 10*b* in the immersion nozzle 10, includes: a drive device 71 that applies a force for changing the direction; and a transmission unit 90 that transmits the force from the drive device 71 to the immersion nozzle quick replacement mechanism 20, and the drive device 71 is operated such that the immersion nozzle 10 together with the immersion nozzle quick replacement mechanism 20 holding the immersion nozzle 10 is horizontally swirled around a center axis P of the immersion nozzle 10. Consequently, the immersion nozzle can be easily held and rotated.

The top surface of the immersion nozzle 10 is in slide contact with a bottom surface 9*a* of a lower nozzle 9 located below the stopper 5. Consequently, the immersion nozzle can be smoothly rotated.

BRIEF DESCRIPTION OF DRAWINGS

In FIG. 3, an unused immersion nozzle and a used immersion nozzle illustrated by chain double-dashed lines indicate positions at the time of nozzle replacement, and nothing is placed in these regions when a discharge direction is changed.

DESCRIPTION OF EMBODIMENTS

Figure 1:
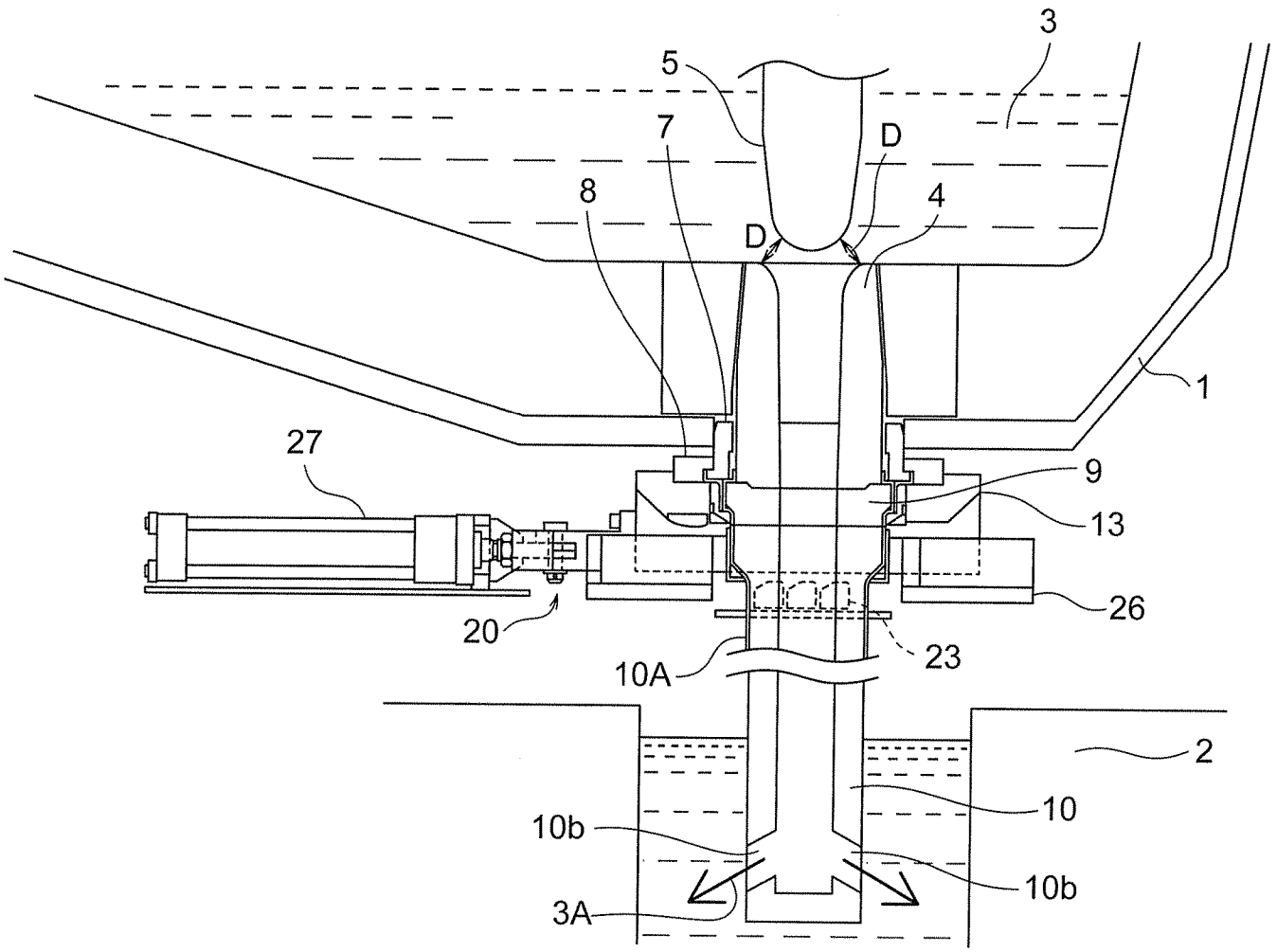
FIG. 1 is a schematic view illustrating a flow path of molten metal from a tundish 1 to a water-cooled mold 2 in an apparatus obtained by providing an immersion nozzle quick replacement mechanism to an iron and steel slab continuous casting apparatus using a general nozzle stopper method.

This invention is aimed at providing a slab continuous casting apparatus configured to freely change a discharge angle of molten metal during casting, and swirl and agitates molten metal in a slab mold to improve quality of an ingot obtained by solidifying the molten metal.

EXAMPLES

Referring to the drawings, a slab continuous casting apparatus according to preferred embodiments of this invention is described below.

Prior to describing a slab continuous casting apparatus according to this invention, the situation where the applicant of this disclosure developed this invention is described. Specifically, the inventors of this invention discussed a method of obtaining a swirling flow of molten metal in a slab caster by a discharge flow from an immersion nozzle through water model experiments with reference to PTL 2 and PTL 7. The size of the slab caster in the water model experiments was equal to that of an actual machine, which had a slab thickness of 250 mm and a slab width of 2,000 mm.

As a result, the inventors of this invention found the following:

(1) A nozzle having two discharge holes as disclosed in PTL 7 is superior to a nozzle having four discharge holes as disclosed in PTL 2.

(2) When the two-hole nozzle is used, it is preferred to bring a discharge flow into contact with the long side. It is not preferred to orient a discharge flow toward the short-side as disclosed in PTL 7.

(3) It is preferred that the discharge direction be oriented in the range of from 15% to 40% of the long side of a mold from an intersection of the short side and the long side of the mold toward the center. In other words, it is not preferred that the discharge direction be 45° as disclosed in PTL 2 or more, and it is not preferred that the discharge direction be made too close to the diagonal.

The inventors of this invention discussed the applications to an actual machine on the basis of these findings.

Regarding the finding (2), PTL 7 refers to PTL 2 to concern about the fact that when a discharge flow contacts with the long side, solidification is delayed or solidified shell is molten again, and breakout occurs in an extreme case. Discussing PTL 2 in detail, however, the aspect ratio of a square mold used in the discussion is about 2:3, and the angles formed by the discharge direction and the respective sides are about 60° and 75°. In PTL 1, which is the invention based on which PTL 2 is, the angles are (45±10°). In comparison, the inventors of this invention have considered that when the technology based on the findings is applied, even if a discharge flow contacts with the long side, the discharge flow has an angle close to a parallel flow unlike PTL 2 and is not greatly affected.

Attempting applications to a real machine on the basis of the above discussion resulted that a sufficient swirling flow was obtained. However, there was a problem in that a sufficient swirling flow was obtained in the initial state of pouring but a sufficient swirling flow cannot be obtained in the middle of pouring. Considering the reasons, two factors were found. The first factor is the influence of drift of a molten metal flow flowing between the stopper 5 and the upper nozzle 4 located at the top of the immersion nozzle. In a flow rate control method using a stopper, the stopper 5 is moved vertically to change the distance from the upper nozzle 4, thereby adjusting the flow rate. In this case, a molten metal flow flowing through the upper nozzle tends to deviate to one side in the immersion nozzle due to shifts of cores of the stopper 5 and the upper nozzle 4, and the angle of the discharge flow is subtly changed. Thus, a sufficient swirling flow was not obtained. The second factor is the influence of inclusions adhering the inside of nozzles. In general, inclusions in molten metal deposit in the vicinity of discharge holes in the immersion nozzle in a while after the start of casting, and the discharge flow of molten metal is sometimes changed. In particular, if inclusions deposit on one side of the discharge port, the direction of the discharge flow changes during pouring, and a sufficient swirling flow cannot be obtained.

Also in such cases, sufficient agitation effect is required for molten metal in a mold. From the foregoing, the inventors of this invention have considered the necessity of an apparatus capable of changing the discharge direction during pouring and capable of replacing the immersion nozzle, and arrived at this invention.

FIG. 1 is a schematic view of a flow path of molten metal from a tundish 1 to a water-cooled mold 2 in a continuous casting machine provided with an iron and steel slab immersion nozzle quick replacement device using a general nozzle stopper method.

Molten metal 3 stored in the tundish 1 passes through a gap D between a stopper 5 and an upper nozzle 4 and is supplied to an immersion nozzle 10 having an immersion nozzle case 10A through a lower nozzle 9. In this case, the vertical position of the stopper 5 is changed to adjust the size of the gap D between the stopper 5 and the upper nozzle, thereby adjusting the flow rate of the molten metal 3. The molten metal 3 may be supplied from the upper nozzle 4 directly to the immersion nozzle 10 without using the lower nozzle 9. The molten metal 3 ejected from a discharge port 10*b* in the immersion nozzle 10 is solidified in a water-cooled mold 2.

The upper nozzle 4 is held by a positioning guide 7 and a positioning press 8 provided on the inner side of a housing 13.

Next, an immersion nozzle quick replacement mechanism 20 including a guide rail 26 and a clamper 23 is configured to hold the immersion nozzle 10 and push the immersion nozzle 10 upward. The immersion nozzle quick replacement mechanism 20 is attached below the lower nozzle 9, so that the immersion nozzle can be easily replaced when the erosion of the immersion nozzle becomes severe during continuous-continuous casting.

Figure 2:
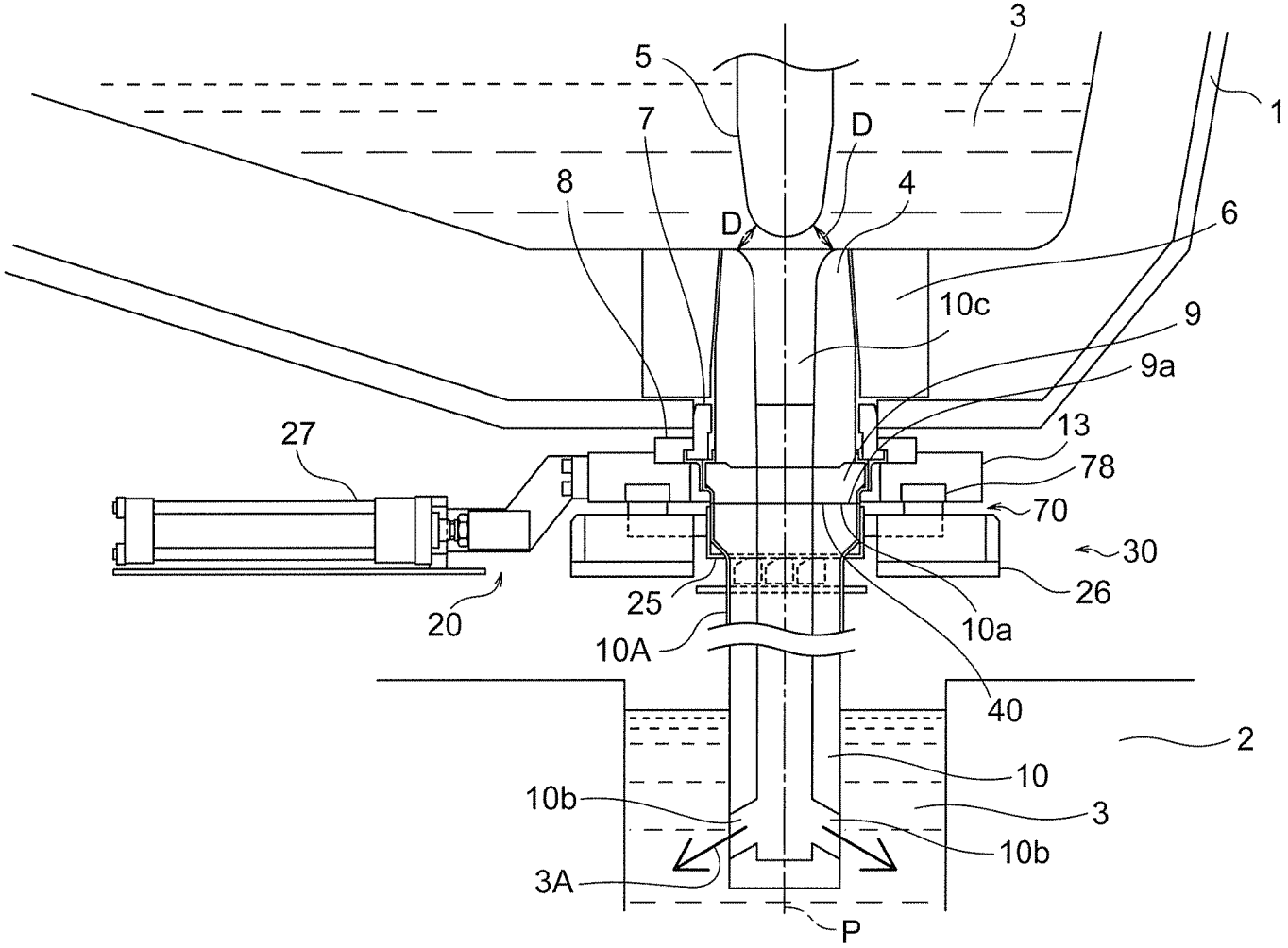
FIG. 2 is a front view illustrating a slab continuous casting apparatus in which a discharge direction change mechanism is placed between a lower nozzle and an immersion nozzle according to this invention.

Next, the configuration in this invention and its fundamental functions are described with reference to FIG. 2.

The same or equivalent parts to those in FIG. 1 are denoted by the same reference symbols.

This invention has a feature in that the discharge direction change mechanism 30 capable of freely changing a discharge angle of the molten metal 3 in a horizontal cross-section during casting is provided between the upper nozzle 4 and the immersion nozzle 10, and has an effect in that a discharge direction necessary for obtaining a swirling flow can be set by enabling the angle to be changed during casting. Thus, a satisfactory swirling flow can be continuously obtained. In particular, the discharge direction of the molten metal 3 needs to be changed mainly in the following three cases.

The first case is that an inclusion is deposited in the vicinity of the discharge port 10*b* during casting and the discharge direction from the discharge port 10*b* changes during casting. The change in discharge direction is detected through the observation of the hot water surface in the mold, the change in hot water surface level, the change in temperature installed in the water-cooled mold 2, and other such changes. When the change has occurred, the orientation of the discharge port 10*b* is changed to an appropriate angle, and the discharge direction can be corrected to maintain an appropriate discharge direction.

The flow of molten metal 3 in the mold 2 cannot be directly observed, but the surface of the molten metal 3 (the surface of mold power, which is generally present) in the mold 2 can be observed to estimate the flow of the molten metal 3 in the mold 2. For example, the flow of the molten metal 3 can be determined from the fluctuation in surface height of the molten metal 3 or the manner of flow on the surface (the state of rotation). By visually confirming these conditions, the attachment angle of the immersion nozzle 10 is adjusted so as to achieve an optimum discharge direction.

The fluctuation in surface height of the molten metal 3 can be grasped by a non-contact displacement measurement device (not shown), such as an ultrasonic displacement sensor and an infrared displacement sensor. A thermometer (not shown) (such as a thermocouple) for sensing breakout is installed in the water-cooled mold 2, and the current discharge direction can be grasped by a change in temperature of the thermometer. The discharge angle may be changed on the basis of these pieces of information, and may be automatically controlled.

The second case is that the width or thickness of the water-cooled mold 2 is changed during casting. When the width or thickness of the water-cooled mold 2 is changed, an appropriate discharge direction for obtaining a swirling flow is accordingly changed. Changing the angle during casting enables an appropriate discharge direction to be secured even when the width or thickness of the water-cooled mold 2 is changed.

The third case is that the discharge direction is changed between the unsteady pouring state and the steady pouring state. For example, no swirling flow is generated in the water-cooled mold 2 at an initial stage of casting. For generating a swirling flow in this state, the discharge direction is adjusted to have an angle with which a swirling flow is more easily generated, and the steady state can be reached early. Once a swirling flow is generated in a mold, the swirling flow is maintained due to inertial force of molten metal. In this case, it is preferred to adjust the discharge angle to such an angle at which breakout less occurs. For replacement of ladles in continuous casting and change of kinds of steel in continuous-continuous casting of different kinds of steel, the pouring speed is reduced. These states are unsteady, and hence the above-mentioned method can be used to change the discharge direction so as to reach the steady state earlier. Specific examples of angle adjustment methods that can be employed include forming a large angle between the long side and the discharge direction in the unsteady state at the initial stage of pouring and then sequentially reducing the angle.

The discharge angle is changed in the above-mentioned cases, but without being limited thereto, the discharge angle may be changed during pouring as necessary.

Next, a slab continuous casting apparatus according to this invention is described with reference to FIG. 2 to FIG. 9, but the drawings are illustrative and this patent is not limited thereto. The immersion nozzle quick replacement mechanism can employ a commonly-used mechanism, and is not limited to the device described herein.

The discharge direction change mechanism 30 includes a sliding surface 40 provided on an immersion nozzle top surface 10*a* of the immersion nozzle 10 of discharge direction is to be changed, the immersion nozzle quick replacement mechanism 20, and a drive mechanism 70 for changing the discharge direction of the molten metal 3 discharged from the immersion nozzle 10.

It is preferred to provide the discharge direction change mechanism 30 at a position between the upper nozzle 4 and the immersion nozzle 10.

Figure 3:
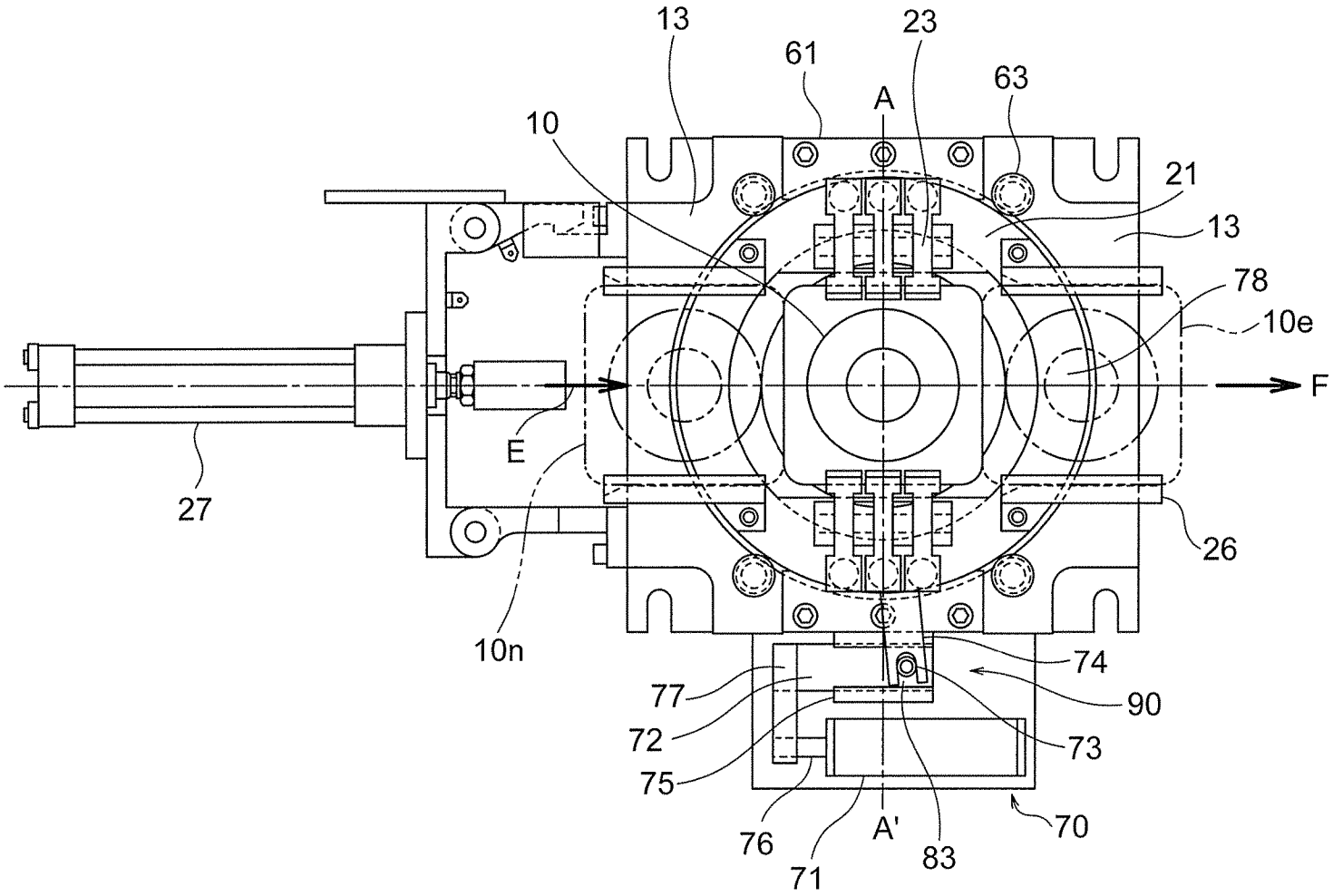
FIG. 3 is a plan view of FIG. 2.

In general, an immersion nozzle quick replacement device replaces an immersion nozzle in a manner that a used immersion nozzle 10*e* illustrated in FIG. 3 is pushed by an unused immersion nozzle 10*n* along one axis, thereby moving the unused immersion nozzle 10*n* to a casting position and moving the used immersion nozzle 10*e* to a discard position. Thus, it is a common practice to form flange portions of the immersion nozzle to be not point symmetric but axisymmetric, for example, a rectangular shape, and move the immersion nozzle 10 along one side of the rectangle for replacement.

On the other hand, the apparatus in this invention changes the direction of the discharge port 10*b* during pouring, and hence a part of the immersion nozzle 10 corresponding to a square flange 25 is accordingly rotated around the center axis of the immersion nozzle 10. However, the immersion nozzle 10 cannot be replaced unless one side of the square flange 25 part is parallel to the replacement direction of the immersion nozzle 10.

To deal with this, a simple method is such that the immersion nozzle 10 together with the immersion nozzle quick replacement mechanism 20 is rotated, and the immersion nozzle is replaced with another one after returning to the immersion nozzle to a replacement position.

Figure 4:
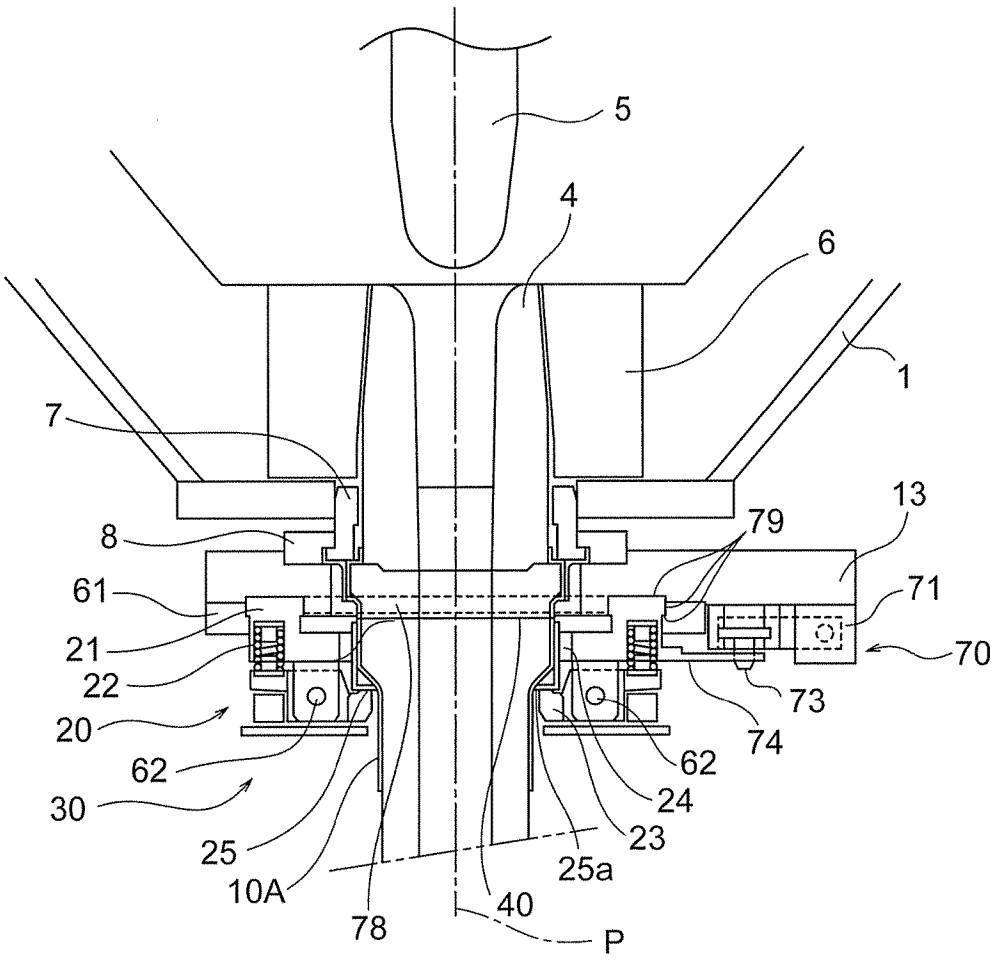
FIG. 4 is a cross-sectional view taken along the line A-A' in FIG. 3.

As described above, the lower nozzle 9 may be placed between the upper nozzle 4 and the immersion nozzle 10, and in this case, it is preferred to place the sliding surface 40 between the lower nozzle 9 and the immersion nozzle 10. In the case where the lower nozzle 9 is not provided, the sliding surface 40 may be placed between the upper nozzle 4 and the immersion nozzle 10. FIG. 2 and FIG. 4 illustrate the case where the lower nozzle 9 is installed between the upper nozzle 4 and the immersion nozzle 10.

Note that a metallic immersion nozzle case 10A is provided on the upper outer periphery of the immersion nozzle 10 as is well known.

Next, the sliding surface 40 in FIG. 4 used for enabling the discharge direction of the immersion nozzle 10 to be changed is formed by an immersion nozzle top surface 10*a* of the immersion nozzle 10 and a lower nozzle bottom surface 9*a* of the lower nozzle 9. In the case where the lower nozzle is not used, the sliding surface 40 is formed by the immersion nozzle top surface 10*a* of the immersion nozzle 10 and the bottom surface of the upper nozzle 4. For changing the discharge direction of the molten metal 3, the immersion nozzle 10 changes the angle so as to horizontally turn about the center axis P of the immersion nozzle 10, and rotationally slides on the sliding surface 40. The sliding surface 40 enables the discharge direction to be changed while maintaining the air tightness. If the air tightness is not maintained, there is a problem in that when the molten metal 3 flows from the lower nozzle 9 to the immersion nozzle 10, the pressure in the vicinity of the flow is decreased in accordance with Bernoulli's law, with the result that a large amount of air is sucked in the molten metal 3 to oxide the molten metal 3, and a large amount of air bubbles is taken in a slab after cooled, which is not preferable. Further, if the air tightness is not maintained, when a carbon-containing refractory is used, the refractory in which carbon is oxidized by intake air is damaged, and a significant damage of the refractory can lead to breakdown, which is not preferable.

The sliding surface 40 is not so much worn because the frequency of changing the orientation of the discharge port 10*b* is not so high. Thus, a refractory of the sliding surface 40 is not particularly limited. It is more preferred to use a refractory containing carbon because carbon serves as a solid lubricant.

The sliding surface can be formed to be flush with the top surfaces of new and old immersion nozzles in the immersion nozzle quick replacement mechanism 20.

Figure 9:
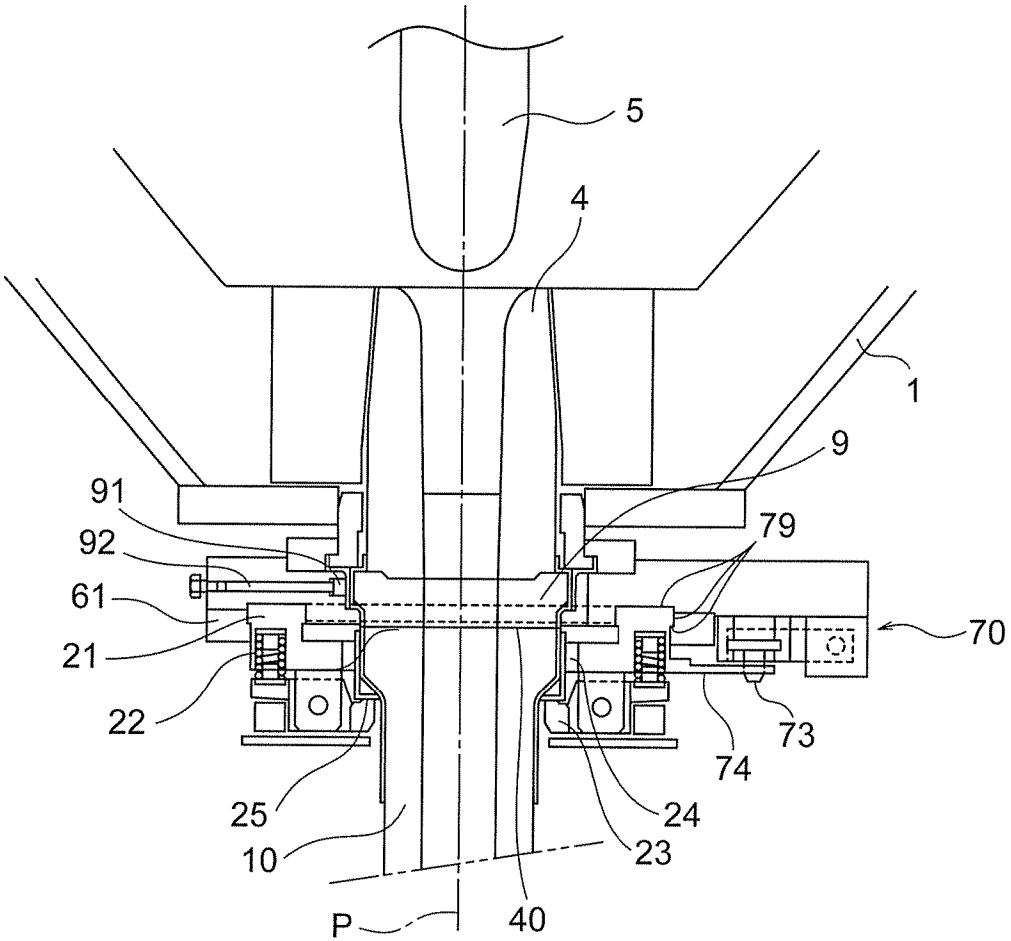
FIG. 9 is a structure example illustrating a structure for preventing corotation of a lower nozzle according to this invention.

In order for the lower nozzle 9 not to be simultaneously corotated at the time of changing the angle of the immersion nozzle discharge port 10*b*, the lower nozzle 9 is fastened with a fixing bolt 92 as illustrated in FIG. 9 so as to be prevent the rotation by an attachment 91. The lower nozzle 9 may be chamfered. The circular shape of the lower nozzle 9 may be changed to a rectangular shape to prevent the rotation.

Next, the immersion nozzle quick replacement mechanism 20 in FIG. 4 is described.

Figure 5:
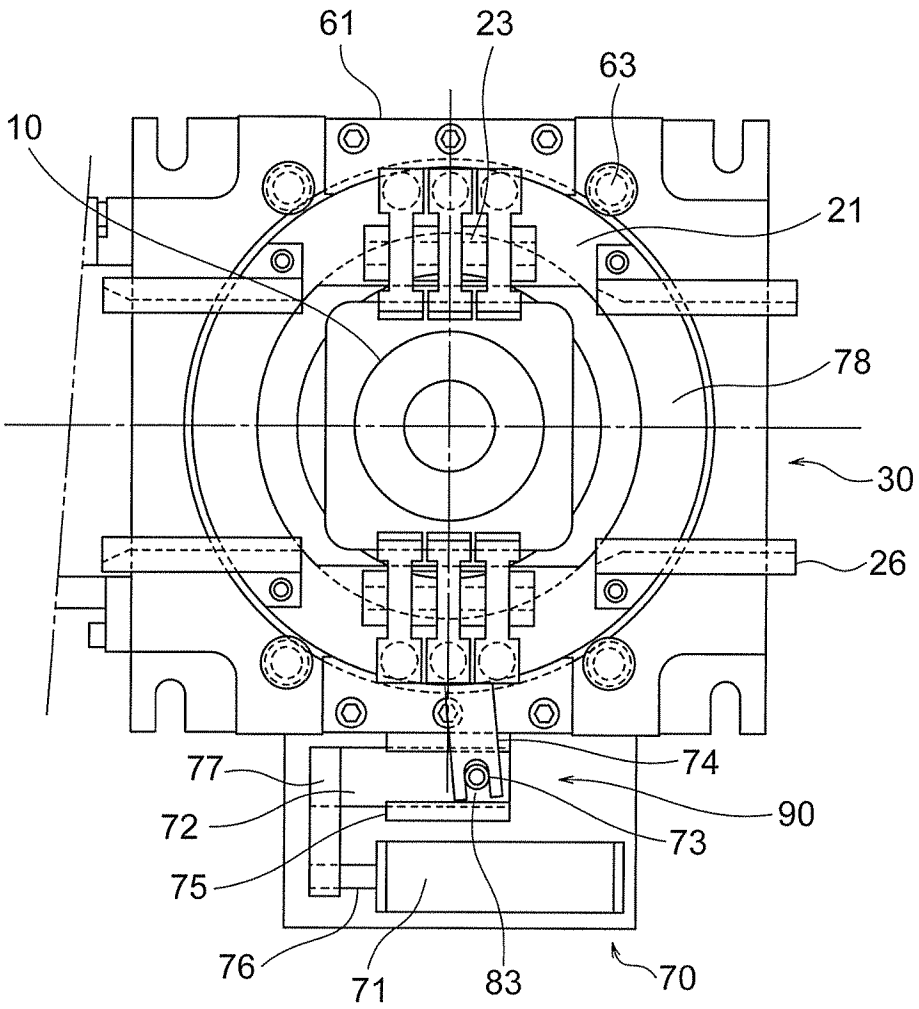
FIG. 5 is an enlarged view of the discharge direction change mechanism according to this invention in FIG. 3.

As illustrated in FIG. 4, the immersion nozzle quick replacement mechanism 20 includes a base 21, a clamper 23 supported via a clamper pin 62 provided to the base 21, and a spring 22 provided to the base 21 and used for biasing the clamper 23 upward. The clamper 23 and the spring 22 are a pair of mechanisms provided to be opposed to each other at 180 degrees. The right and left bases 21 are coupled by a coupling bar 78. The immersion nozzle 10 inserted along the guide rail 26 is configured such that the flange bottom surface 25*a* is supported by a plurality of the clampers 23, and the clampers 23 push the immersion nozzle 10 upward with the force of the spring 22 via the clamper pin 62 as a fulcrum by using the principle of leverage. This motion presses the sliding surface 40 upward in the vertical direction with an appropriate force to maintain the air tightness from the sliding surface 40. FIG. 5 is an enlarged view of the immersion nozzle quick replacement mechanism 20 illustrated in FIG. 3. The type of the spring 22 is not limited. Although the spring 22 in the figures is a coil spring, a disc spring or a plate spring may be used.

The magnitude of the pressing force is preferably 100 to 2,000 kPa in terms of surface pressure. When the pressing force is less than 100 kPa, sufficient air tightness cannot be maintained to increase the risk of breakout, which is not preferable. When the pressing force is more than 2,000 kPa, the resistance on the sliding surface becomes too large to change the angle, which is not preferable. On the other hand, it is also possible to strongly press the sliding surface 40 in normal times, loosen the sliding surface 40 at the time of changing the angle, and strongly press the sliding surface 40 again for fixation.

In the immersion nozzle quick replacement device 20, the base 21 is held by a support guide 61 and a support guide roller 63 that are held by the housing 13, the clamper 23 is held by a clamper pin 62 attached to the base 21, and the immersion nozzle 10 is held by the clamper 23 (FIG. 3, FIG. 4).

The outer periphery of the base 21 has a circular key-shaped cross-section centered at the center axis P of the immersion nozzle. The support guide 61 supporting the base 21 also has a circular key-shaped cross-section centered at the nozzle center axis P, and the support guide roller 63 also has a key-shaped cross-section. The support guide 61 is held by the housing 13. The base 21 and the support guide 61 are formed of rotation surfaces that come into slide contact with each other around the center axis P, and are attached so as to be rotatably in slide contact with each other. Sliding surfaces 79 of the support guide 61 and the base 21 constitute key-shaped bottom and side surfaces of the base 21. The sliding surface 79 is also formed between the housing 13 and the base 21. It is preferred to provide an appropriate clearance between the base 21 and the housing 13, but an excessively large clearance is not preferred because backlash of the apparatus is too large. It is therefore desired that the clearance is reduced as much as possible in consideration of thermal expansion.

Upon the reception of the force from the drive device 71 for changing the angle as described later, the base 21 held by the housing 13 so as to be slidable slides in a rotation direction around the center axis P, and rotates the immersion nozzle held via the clamper 23, thereby changing the discharge direction of the discharge port 10*b*. The sliding surfaces 79 of the housing 13 and the base 21 may be applied with an appropriate lubricant. A bearing or other such components may be placed on the surfaces.

Next, the drive mechanism 70 for changing the discharge direction is described. The drive mechanism 70 for changing the discharge direction, which is configured to drive the discharge direction change mechanism 30 of the immersion nozzle 10 for the molten metal 3 includes a drive device 71 that applies a force for changing the angle, and a transmission unit 90 that transmits the force from the drive device 71 to the immersion nozzle quick replacement mechanism 20 in which the immersion nozzle 10 is held.

First, the transmission unit 90 is described. The transmission unit 90 includes a lever 74 and a pin 73 (FIG. 3, FIG. 5).

The lever 74 is fixed to the base 21. The size (width and length) of the lever 74 is not particularly limited. By applying a force in the horizontal direction or a force in the direction of rotating around the center axis P of the immersion nozzle 10 to the distal end of the lever 74 via the pin 73, the base 21 is rotated around the center axis P to change its angle, and at the same time, the immersion nozzle 10 held by the immersion nozzle quick replacement mechanism 20 also changes its angle, thus enabling the discharge direction to be changed.

Figure 6:
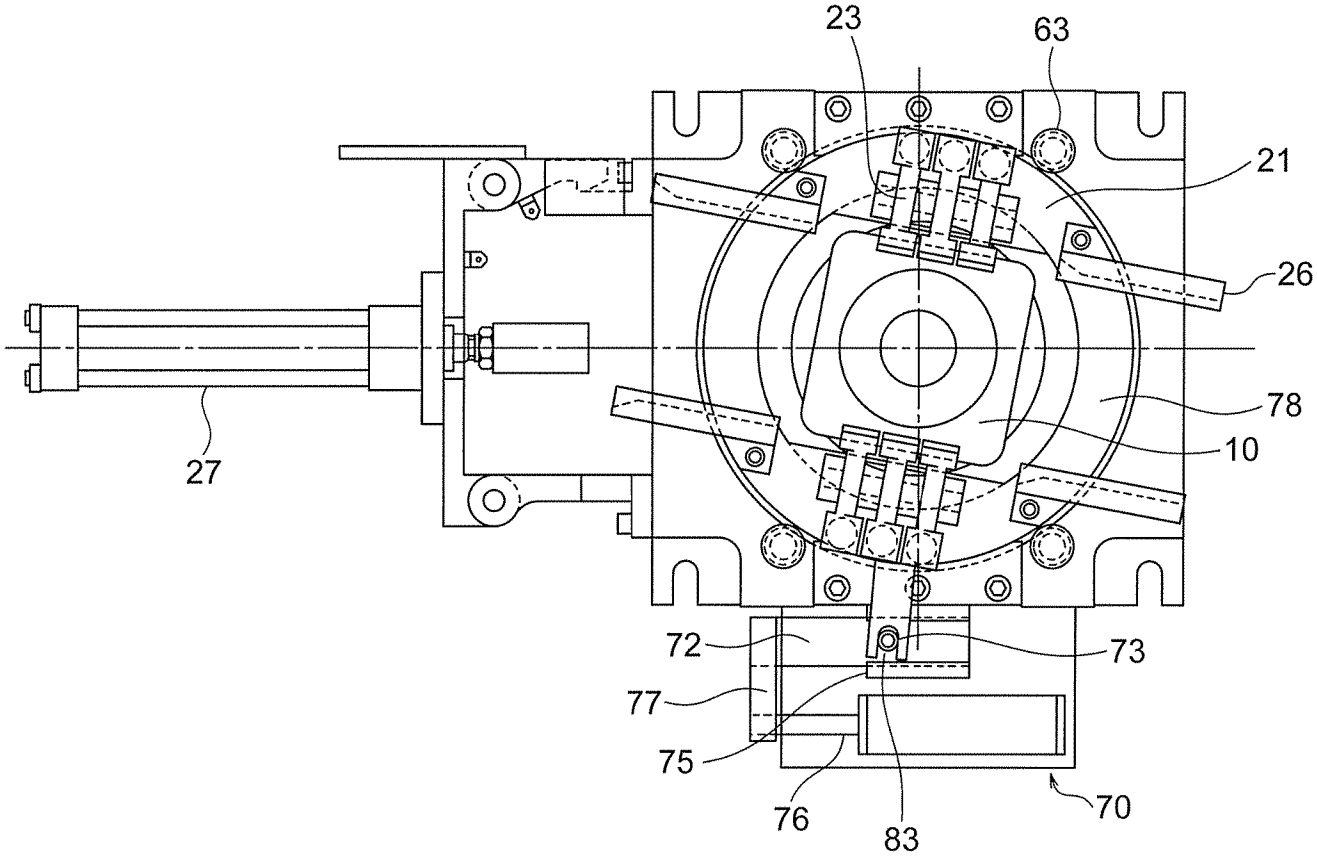
FIG. 6 is an exemplary view illustrating a swirl position at which a discharge angle is changed by the discharge direction change mechanism according to this invention in FIG. 3.
Figure 7:
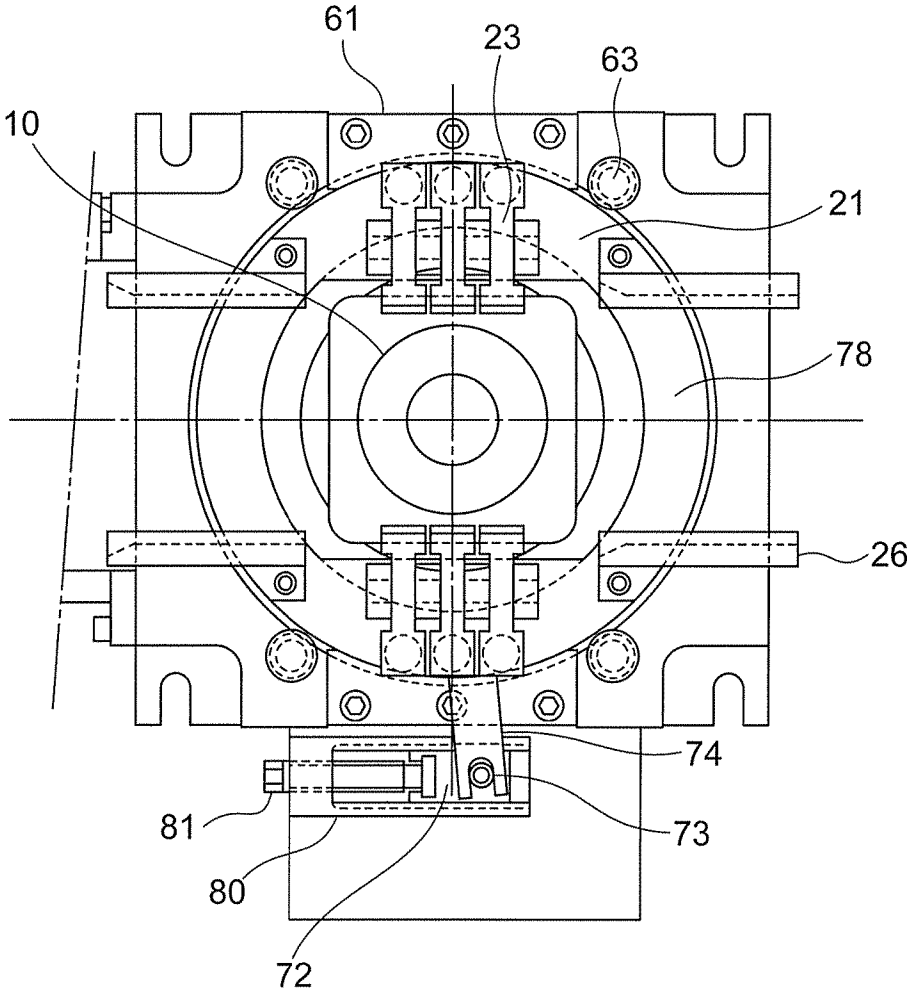
FIG. 7 is another structure example of a drive device for the discharge direction change mechanism for the immersion nozzle according to this invention.

By applying the force from the drive device 71 to the distal end of the lever 74, the discharge angle can be changed (FIG. 6).

For the drive device 71, for example, a hydraulic cylinder can be used. The hydraulic cylinder is fixed to the housing 13. A slider 72 is mounted at the distal end of a rod 76 via a coupling member 77. The distal end of the rod 76 and the slider 72 slide simultaneously. The slider 72 is supported by the housing 13 via a guide 75. A pin 73 is provided in the slider 72. The pin 73 is disposed so as to be coupled to a pin hole 83 in FIG. 6 of the lever 74 fixed to the base 21. Accordingly, when the drive device 71 is driven, the discharge angle can be changed. In FIG. 6, the pin hole 83 has a U shape obtained by cutting one side of an oval. The pin hole 83 is not limited thereto, and may have an oval shape. The coupling method is not limited to the structure in Examples. Any coupling method can be used as long as the motion of the drive device 71 is transmitted as rotational motion of the immersion nozzle 10.

The drive device 71 is not limited to a hydraulic cylinder. The slider 72 may be slid via a female thread block 80 by rotational motion of a screw rod 81 in FIG. 7. In this case, a motor or a reducer rather than a hydraulic motor is used for the drive device 71.

Figure 8:
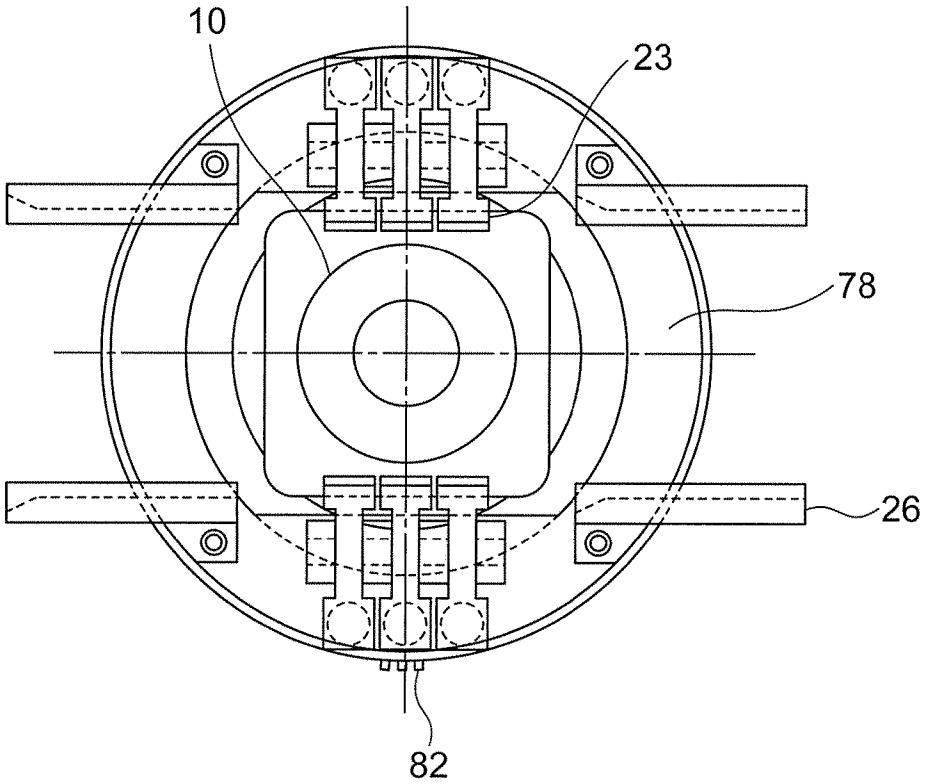
FIG. 8 is another structure example of the drive device for the discharge direction change mechanism for the immersion nozzle according to this invention.

Instead of using the lever 74, a circular gear 82 may be provided at a part of the outer circumference of the base 21, and a worm gear, a belt, a reducer, or a motor may be used for the drive device 71 (FIG. 8. Worm gear, belt, reducer, and motor are not shown).

It is preferred that the variable angle of discharge be at least 30° or more. By adjusting the immersion nozzle 10 at an optimal position, the change of the angle during operation can be reduced to about ±10°. However, the variable angle can be set to about 60° in consideration of various usages.

FIG. 6 illustrates an example of this invention after the discharge angle is changed.

Next, the above-mentioned sliding surface 40 is provided on the top surface 10*a* of the immersion nozzle 10.

The immersion nozzle 10 has a molten metal inflow path 10*c* at an upper part thereof, and has a pair of axisymmetrically opposed discharge ports 10*b* at a lower part thereof. The immersion nozzle 10 is shaped such that discharge flows 3A of the molten metal 3 are discharged toward the short-side wall surfaces of the water-cooled mold 2. The shapes of the molten metal inflow path 10*c* and the discharge ports 10*b* are not particularly limited, and square shapes, circular shapes, and other shapes can be used. Regarding the number of the discharge holes, an immersion nozzle having two opposed holes as described above is preferred. A three-hole immersion nozzle 10 in which another discharge port 10*b* is provided at the lower side of the immersion nozzle 10 in addition to the above-mentioned two holes may be used.

It is preferred that the molten metal 3 be discharged from the immersion nozzle 10 having two opposed holes toward the long sides, and the discharge direction be oriented in the range of from 15% to 40% of the long-side length from an intersection between the short side and the long side of the mold in the direction of the center of the long side. When the range is less than 15%, a part of the flow comes into contact with the short side, and a swirling flow cannot be efficiently generated. When the range is larger than 40%, after the discharge flow 3A contacts with the long side, the discharge flow 3A cannot continue to flow to the short side along the long side. Also in this case, a swirling flow cannot be efficiently generated. The range is more preferably 20% to 35%.

The immersion nozzle top surface 10*a* is in contact with the lower nozzle bottom surface 9*a* to form the sliding surface 40. The transverse section of the lower nozzle 9 is circular in general, and hence it is preferred that the sliding surface 40 be also circular. On the other hand, in the immersion nozzle quick replacement mechanism 20, a square flange 25 is attached to an immersion nozzle top surface. It is therefore desired that the periphery of the circular sliding surface be protected by an iron-sheet case, and the square flange 25 conforming to the clamper 23 that holds and presses the immersion nozzle be attached to an outer peripheral portion of the iron-sheet case. Consequently, the immersion nozzle can be smoothly held and attached, and the deformation of the upper part of the immersion nozzle can be reduced to improve the sealing performance and obtain the strength, thereby suppressing the occurrence of cracks in the immersion nozzle. The square flange 25 on the outer periphery is separated away from the sliding surface 40, and hence there is an advantage in that a deformation of the flange portion does not adversely affect the sealing performance of the sliding surface 40.

The following method can be employed for mounting and removal, that is, quick replacement, of the immersion nozzle 10. However, no problem occurs if any other similar methods are used.

The discharge direction of the immersion nozzle 10 is appropriately changed during continuous casting. If the discharge direction has been changed, the immersion nozzle cannot be quickly replaced with no adjustment. For quick replacement of the immersion nozzle, the angle of the immersion nozzle 10 is first adjusted such that one side of the square flange 25 parallel to the discharge direction of the immersion nozzle 10 is parallel to the guide rail 26. If the one side of the square flange 25 is not parallel to the guide rail 26, the square flange 25 of the immersion nozzle 10 interferes with the guide rail 26 to hinder the replacement of the nozzle.

Next, an unused immersion nozzle 10*n* is set at a position indicated by the chain double-dashed line in FIG. 3.

The opening degree of the stopper 5 is decreased to reduce the pouring speed, and then the stopper 5 is completely closed, thereby temporarily stop the injection of molten steel from the immersion nozzle into the mold.

The immersion nozzle replacement drive device 27 is used to push the unused immersion nozzle 10*n* rightward in FIG. 3 as indicated by the arrow E. The immersion nozzle 10 is pushed by the unused immersion nozzle 10*n*, and moves to the position of the used immersion nozzle 10*e*. The immersion nozzle 10 is stopped when the position of the center axis of the unused immersion nozzle 10*n* reaches the center position P of the immersion nozzle 10 before the movement. Due to the action of the clamper 23, the unused immersion nozzle 10*n* is pushed against the bottom surface of the lower nozzle 9.

After that, the stopper 5 is opened to start the supply of molten steel through the unused immersion nozzle 10*n*, and continuous casting is restarted.

After that, the used immersion nozzle 10*e* is taken to the outside of the mold as indicated by the arrow F in FIG. 3.

Next, a refractory for forming the above-mentioned stopper 5 used in this invention is not required to have a special structure, and a commonly-used refractory can be used. Specific examples of the material that can be used include alumina-carbon, alumina, high alumina, and pagodite.

The structure of the refractory may be either of a sleeve type obtained by combining short sleeve bricks or a monoblock type obtained by integrally molding the whole component.

For the lower nozzle 9, a general nozzle known in the market can be used. For example, an alumina-carbon refractory can be used. Alumina-carbon, alumina-zirconia-carbon, spinel-carbon, and magnesia-carbon refractories can be used. Materials not containing carbon, such as alumina, magnesia, zircon, and zirconia, can be used.

The shapes of the refractories are not particularly limited except for countermeasures to prevent corotation with the sliding surface 40 described above.

The material of a refractory that can be used for the immersion nozzle 10 is not particularly limited. Refractories made of oxides alone, such as $Al_2O_3$, $SiO_2$, MgO, $ZrO_2$, CaO, $TiO_2$, and $Cr_2O_3$, and refractories obtained by combining oxides and vein graphite, synthetic graphite, or carbon such as carbon black can be used. Examples of starting ingredients that can be used include materials containing one kind of the oxides as a main component, such as alumina and zirconia, and materials made of two or more kinds of the oxides, such as mullite formed from $Al_2O_3$ and $SiO_2$, and spinel formed from $Al_2O_3$ and MgO. These starting ingredients were adjusted and blended so as to satisfy characteristics of each site of an immersion nozzle, thereby manufacturing a refractory. Carbides, such as SiC, TiC, and $Cr_2O_3$, and oxides, such as ZrB and TiB, are sometimes added for the purpose of oxidation prevention and sintering control.

The following technology for preventing inclusions in molten metal from depositing in the vicinity of discharge holes in an immersion nozzle is known. Specifically, a method of providing a step to an inner pipe of the immersion nozzle 10 to prevent drift of the molten metal 3 from the inside of the immersion nozzle 10 to the discharge hole 10*b* and a method of arranging a plurality of protrusions to prevent drift of the molten metal 3 from the inside of the immersion nozzle 10 to the discharge hole 10*b*, which is a cause for the deposition of inclusions in the vicinity of discharge holes in the immersion nozzle, are used in combination to suppress a change of the discharge flow 3*a* of the molten metal 3 caused by deposited substances. This technology can be used in conjunction with the subject patent application.

Next, continuous casting of the molten metal 3 was performed by the method according to this invention and the conventional method to manufacture slabs. The mold used had a long-side wall of 1,500 mm, a short-side wall of 200 mm, and a rectangular planar cross-section. For the immersion nozzle, a nozzle having two axisymmetric holes was used. For the molten metal 3, carbon steel having 200 ppm of C, 25 ppm of S, and 15 ppm of P was selected, and the casting speed was 1.5 m/min.

The molten swirling flow in the water-cooled mold 2 was evaluated by observing the surface of the mold 2. The case where a swirling flow was generated and a stable swirling flow was continued during continuous-continuous casting was evaluated as ⊕. The case where a swirling flow was generated but the swirling flow became unstable in the middle was evaluated as ○. The case where a sufficient swirling flow was not generated was evaluated as Δ. The case where no swirling flow was generated at all was evaluated as ×.

The breakout generation index was evaluated by a breakout detector attached to the mold 2 on the basis of the number of alarms of breakouts. The breakout generation index in Comparative Example 7 was set to 1.0, and the values are proportional to the number of alarms. A larger numerical value indicates that breakouts are more liable to be generated.

The surface defect generation index was evaluated by determining the number of surface defects from conditions of slabs. The surface defect generation index in the second charge in Comparative Example 7 was set to 1.0, and the values are proportional to the number of defects. Note that troubles and defects at the start of pouring are liable to occur in the first charge in continuous-continuous casting, and defects can occur due to disasters in this invention and in the conventional method, and hence the surface defect generation index was evaluated in the second charge causing a clear difference. To know influences such as nozzle clogging, the surface defect generation index similarly was evaluated for slabs in the fifth charge in continuous-continuous casting. Also in this case, the surface defect generation index in the second charge in Comparative Example 7 was set to 1.0.

TABLE 1

| Slab thickness: 200 mm Slab width: 1,500 mm | | | | | | | | | | |
|---|---|---|---|---|---|---|---|---|---|---|
| | Example 1 | Example 2 | Example 3 | Comparative Example 1 | Comparative Example 2 | Comparative Example 3 | Comparative Example 4 | Comparative Example 5 | Comparative Example 6 | Comparative Example 7 |
| Discharge direction | | | | | | | | | | |
| Intersection between discharge direction and mold | Long side | Long side | Long side | Long side | Long side | Long side | Long side | Long side | Short side | Short side |
| Distance from mold intersection (ratio to long-side length) | 35% | 30% | 20% | 45% | 35% | 30% | 20% | 10% | | |
| Intersection on short side | | | | | | | | | Middle between short-side center and intersection | Short-side center |
| Whether discharge direction is fixed | Variable | Variable | Variable | | | | | | | |
| Variable | | | | | | | | | | |
| Fixed | | | | Fixed | Fixed | Fixed | Fixed | Fixed | Fixed | Fixed |
| Swirling flow | ⊕ | ⊕ | ⊕ | X | Δ | ○ | ○ | Δ | Δ | X |
| Breakout index | 0.85 | 0.85 | 0.85 | 1.4 | 0.85 | 0.8 | 0.8 | 0.8 | 0.9 | 1.0 |
| Surface defect generation index | 0.25 | 0.22 | 0.24 | 0.75 | 0.35 | 0.3 | 0.3 | 0.65 | 0.9 | 1.0 |
| Second charge in continuous-continuous casting | | | | | | | | | 0.9 | 1.1 |
| Fifth charge in continuous-continuous casting | 0.26 | 0.24 | 0.24 | 1.01 | 0.74 | 0.66 | 0.67 | 0.88 | 1.08 | 1.3 |
| Remarks | | | | Compliant to Document 1 | | | | | Compliant to Document 7 | Normal method |

Table 1 shows results obtained when the mold width was constant. In Examples 1 to 3, the discharge directions were changed such that the ratio of the distance from a mold intersection with respect to the long-side length was changed to 35%, 30%, and 20%, respectively. A molten metal flow on the mold surface was observed in the middle of continuous casting, and the casting was performed by changing the discharge direction by about ±5°. In any of the cases, a stable swirling flow was obtained. The breakout generation index in the mold was not changed from the conventional one, and the surface defect generation index in each Example had a small value.

In Comparative Example 1, the discharge direction was fixed to 45%, which is compliant to Document 1, no swirling flow was generated at all. The breakout index was deteriorated. The surface defect generation index was slightly reduced from Comparative Example 7, but the degree of the reduction was not so large.

Comparative Examples 2 to 4 are the case where the initial discharge directions were the same as in this invention 1 to 3 but the discharge directions were not changed during casting. The swirling flow was satisfactory in the initial stage, but gradually became unstable along with the increase in number of times of continuous-continuous casting. The breakout index was not changed from the conventional one. The surface defect generation index in the second charge in the initial stage of pouring had a small value, but tended to increase in the fifth charge. After casting, the asymmetric adhesion of inclusions was found in the immersion nozzle. Thus, it is considered that drift has occurred due to asymmetrically adhered inclusions and the molten metal flow in the mold did not continue to swirl.

Comparative Example 5 is the case where the discharge direction was set such that the ratio of the distance from the mold intersection with respect to the long-side length was 10%. Comparative Example 6 is an example based on Document 7. A swirling flow was generated but not considered sufficient. The surface defect generation index was slightly reduced from Comparative Example 7, but the degree of the reduction was not so large.

Comparative Example 7 is a commonly practice. No swirling flow was obtained, and the surface defect generation index was larger than those in other examples. Comparative Example 7 is 100, and was compared between the second charge and the fifth charge after the change of the width.

In Examples, the discharge directions were changed such that the ratio of the distance from the mold intersection with respect to the long-side length was changed to 35%, 30%, and 20% so as to follow the change of the width. After that, the angle was adjusted by about ±5°. In this invention, a stable swirling flow was achieved, the breakout index was not changed from the conventional one, and the surface defect generation index indicated a low value.

In contrast, Comparative Examples 8 to 17 are the cases where the width was changed under the pouring conditions in Comparative Examples 1 to 7, respectively. Because the discharge direction was fixed from that when the width was 1,500 mm, the numerical value of the discharge direction with respect to the long side was changed so as to be larger along with the change of the width to 1,800 mm.

Comparative Examples 8 and 14 have the same results as in Comparative Examples 1 and 7, and sufficient swirling flows were not obtained. In Comparative Examples 9 to 11, sufficient swirling flows were no longer obtained after the pouring with the width of 1,500 mm, and hence the evaluation of the swirling flows was Δ.

TABLE 2

| Width was changed from 1500 mm to 1800 mm | | | | | | | | | | |
|---|---|---|---|---|---|---|---|---|---|---|
| | Example 4 | Example 5 | Example 6 | Comparative Example 8 | Comparative Example 9 | Comparative Example 10 | Comparative Example 11 | Comparative Example 12 | Comparative Example 13 | Comparative Example 14 |
| Discharge direction | | | | | | | | | | |
| Intersection between discharge direction and mold | Long side | Long side | Long side | Long side | Long side | Long side | Long side | Long side | Short side | Short side |
| Distance from mold intersection (ratio to long-side length) | 35% | 30% | 20% | 46% | 38% | 34% | 26% | 18% | | |
| Intersection on short side | | | | | | | | | Middle between short-side center and intersection | Short-side center |
| Whether discharge direction is fixed | | | | | | | | | | |
| Variable | Variable | Variable | Variable | | | | | | | |
| Fixed | | | | Fixed | Fixed | Fixed | Fixed | Fixed | Fixed | Fixed |
| Swirling flow | ⊕ | ⊕ | ⊕ | X | X | Δ | Δ | Δ | X | X |
| Breakout index* | 0.85 | 0.85 | 0.85 | 1.4 | 1.25 | 0.9 | 0.8 | 0.8 | 0.9 | 1.0 |
| Surface defect generation index | 0.25 | 0.26 | 0.24 | 1.01 | 0.80 | 0.79 | 0.78 | 0.95 | 0.9 | 1.0 |
| Second charge after width change | | | | | | | | | 1.08 | 1.48 |
| Fifth charge after width change | 0.26 | 0.22 | 0.25 | 1.08 | 0.89 | 0.82 | 0.81 | 1.06 | 1.21 | 1.53 |
| Remarks | | | | Compliant to Document 1 | | | | | Compliant to Document 7 | Normal method |

Table 2 shows results obtained by using the above-mentioned mold with a width of 1,500 mm to perform continuous-continuous casting of five charges and changing the width of the mold from 1,500 mm to 1,800 mm.

The above-mentioned swirling flows indicate results after the width was changed, and the same evaluation method is the same as in Table 1. The breakout index was evaluated by a method similar to Table 1 in which Comparative Example 7 is 100. The surface defect generation index was evaluated by the same evaluation method as in Table 1 in which In Comparative Example 13, no swirling flow was obtained after the width was changed.

In the case where a sufficient swirling flow was not obtained, the surface defect generation rate was correspondingly increased along with the increase in number of continuous-continuous charges.

Thus, the advantage of this invention over Comparative Examples is obvious.

INDUSTRIAL APPLICABILITY

The slab continuous casting apparatus according to this invention is configured such that an immersion nozzle can be quickly replaced during continuous-continuous casting, and the drive mechanism is used to enable the immersion nozzle to be rotated together with the immersion nozzle quick replacement mechanism holding the immersion nozzle and enable the direction of a discharge flow from the immersion nozzle to be freely changed during casting, thereby improving the quality of slabs.

The invention claimed is:

1. A slab continuous casting apparatus comprising:

a tundish for supplying molten metal to a water-cooled mold through at least an upper nozzle;

a stopper;

an immersion nozzle having discharge port, configured to orient and hold, toward a long side of the water-cooled mold, a discharge direction of the molten metal discharged from the discharge port to obtain a swirling flow;

an immersion nozzle quick replacement mechanism;

and a discharge-direction changing mechanism provided between the stopper and the immersion nozzle and is capable of freely changing a discharge angle of the molten in a horizontal cross section during casting.

2. The slab continuous casting apparatus of claim 1, wherein the water-cooled mold has a ratio of a length of a long-side wall to a length of a short-side wall of 5 or more.

3. The slab continuous casting apparatus of claim 2, wherein the top surface of the immersion nozzle is in slide contact with a bottom surface of a lower nozzle located below the stopper, or in slide contact with a bottom surface of the upper nozzle paired with the stopper.

4. The slab continuous casting apparatus of claim 1, wherein the discharge direction change mechanism includes:

a sliding surface provided on at least a top surface of the immersion nozzle;

an immersion nozzle quick replacement mechanism; and a drive mechanism for changing a discharge direction of the molten metal discharged from the immersion nozzle.

5. The slab continuous casting apparatus of claim 4, wherein the immersion nozzle quick replacement mechanism includes:

a base;

a clamper supported through a clamper pin provided on the base; and a spring provided on the base and used for biasing the clamper upward, the clamper and the spring are a pair of mechanisms provided to be opposed to each other at 180 degrees, and the clamper is configured to support a flange bottom surface of the immersion nozzle inserted along a guide rail, and by being biased upward by the spring, hold the immersion nozzle and push the immersion nozzle upward.

6. The slab continuous casting apparatus of claim 4, wherein the drive mechanism for changing a discharge direction of a discharge port in the immersion nozzle includes:

a drive device that applies a force for changing the direction; and a transmission unit that transmits the force from the drive device to the immersion nozzle quick replacement mechanism, and the drive device is operated such that the immersion nozzle together with the immersion nozzle quick replacement mechanism holding the immersion nozzle is horizontally swirled around a center axis of the immersion nozzle.

* * * * *